US010633811B1

(12) United States Patent
Tsengas et al.

(10) Patent No.: US 10,633,811 B1
(45) Date of Patent: Apr. 28, 2020

(54) APPARATUS AND METHOD FOR COLLECTING AND DISPOSING OF PET WASTE

(71) Applicants: Steven Tsengas, Fairport Harbor, OH (US); Konstantine S. Tsengas, Fairport Harbor, OH (US)

(72) Inventors: Steven Tsengas, Fairport Harbor, OH (US); Konstantine S. Tsengas, Fairport Harbor, OH (US)

(73) Assignee: COSMIC PET LLC, Wichita, KS (US)

( * ) Notice: Subject to any disclaimer, the term of this patent is extended or adjusted under 35 U.S.C. 154(b) by 0 days.

(21) Appl. No.: 16/353,236

(22) Filed: Mar. 14, 2019

Related U.S. Application Data

(63) Continuation-in-part of application No. 15/831,422, filed on Dec. 5, 2017, now abandoned.

(60) Provisional application No. 62/647,797, filed on Mar. 25, 2018, provisional application No. 62/553,867, filed on Sep. 3, 2017.

(51) Int. Cl.
*E01H 1/12* (2006.01)

(52) U.S. Cl.
CPC ..... *E01H 1/1206* (2013.01); *E01H 1/1213* (2013.01)

(58) Field of Classification Search
CPC ..... E01H 1/008; E01H 1/1206; E01H 1/1213; E01H 2001/122; E01H 2001/1226; E01H 2001/1233; A01K 23/005; A47K 11/03; A47K 11/035
USPC ..... 294/1.3, 1.4, 1.5; 4/459, 464, 467
See application file for complete search history.

(56) References Cited

U.S. PATENT DOCUMENTS 4,917,238 A * 4/1990 Schumacher ..... A47L 13/51 206/223
7,182,376 B2 * 2/2007 Maginness ..... E01H 1/006 294/1.3
7,677,618 B2 * 3/2010 Thomann ..... E01H 1/1206 294/1.3
7,909,942 B2 * 3/2011 Wood ..... E01H 1/1213 134/115 R
8,096,597 B2 * 1/2012 Shoseyov ..... E01H 1/1213 294/1.3
8,601,637 B2 * 12/2013 Mainini ..... A01K 1/01 15/319
9,039,053 B2 * 5/2015 Shoseyov ..... E01H 1/1213 294/1.3
2005/0279290 A1 * 12/2005 Hyland ..... E01H 1/1213 119/867
2008/0093486 A1 * 4/2008 Orubor ..... A01M 7/0046 241/15
2010/0026022 A1 * 2/2010 Welch ..... A01K 27/006 294/1.3
2010/0293741 A1 * 11/2010 Ferris ..... A01K 1/01 15/339

(Continued)

*Primary Examiner* — Dean J Kramer
(74) *Attorney, Agent, or Firm* — Gugliotta & Gugliotta LPA

(57) ABSTRACT

An improvement to a pet waste disposal system is provided that utilizes a metered and dispensed chemical neutralizer dispense from a chemical cartridge into a portable mixing chamber to create a neutralizing chemical reaction that transforms a pet waste volume into a compostible waste product. The instant abstract is neither intended to define the invention disclosed in this specification nor intended to limit the scope of the invention in any way.

8 Claims, 14 Drawing Sheets

(56) References Cited

U.S. PATENT DOCUMENTS

2012/0285494 A1* 11/2012 Orubor ..... A01K 1/0128
134/184
2013/0146513 A1* 6/2013 Shoseyov ..... B09B 3/0083
210/85

* cited by examiner

APPARATUS AND METHOD FOR COLLECTING AND DISPOSING OF PET WASTE

RELATED APPLICATIONS

The present invention claims the benefit of U.S. Provisional Application 62/647,797, filed on Mar. 25, 2018, and U.S. Provisional Application 62/553,867, filed on Sep. 3, 2017, and is a continuation in part of U.S. application Ser. No. 15/831,422, filed on Dec. 5, 2017, all of which are incorporated by reference as if fully rewritten herein.

BACKGROUND OF THE INVENTION

1. Field of the Invention

This invention relates generally to pet waste collection and disposal devices and, more particularly, to an improvement to a pet waste disposal system that utilizes a metered and dispensed oxidizing agent to blend and chemically oxidize pet waste through incineration.

2. Description of the Related Art

Pet waste disposal systems using an oxidizing agent to blend and chemically oxidize pet waste through incineration exist. By way of example, U.S. Pat. No. 8,096,597, and related U.S. Pat. No. 9,039,053, each describes an apparatus and method for collecting and disposing of pet wastes. Such devices dispose of pet waste and the like without soiling one's hands, while eliminating bad odor and microbial contamination.

However, the commercial viability of such pet waste incinerators ranges from impractical to impossible by potassium permanganate as an oxidizing agent when used to collect, neutralize and incinerate pet dog or cat feces. According to the Drug Enforcement Administration controls, sodium permanganate as a List II chemical because of its direct substitutability for potassium permanganate (a List II chemical) in the illicit production of cocaine. As such, controls exist for a cumulative threshold of 55 kilograms and 500 kilograms (respectively) for domestic and international transactions. As such, all transactions which meet or exceed these quantities (in a calendar month) are considered regulated transactions, subject to record keeping, reporting and/or import/export notification requirements. Additionally, chemical mixtures having greater than 15 percent sodium permanganate is similarly regulated.

Due to the regulatory and potentially criminal burdens associated with the use of such an oxidizer, both retail establishments and the supply chains supporting them are unwilling or unable to support a commercial product utilizing the oxidizing technology of the prior art.

However, contamination from dog or cat stools continue to pose an environmental contamination problem, especially in urban, and to some extent in suburban areas. Canine feces can transmit a number of different pathogens, including: *Campylobacter* spp. (Gram-negative bacteria); *Escherichia coli* (Gram-negative bacterium); *Salmonella* spp. (Gram-negative bacteria); *Yersinia* spp. (Gram-negative bacteria); *Cyclospora* spp. (protozoan parasite); *Cryptosporidium* spp. (protozoan parasite); Roundworm (including hookworm and whipworm) (parasitic worm); Tapeworm (parasitic worm); and *Toxoplasma* spp. (protozoan parasite). As such, incineration or neutralization of such disease carriers continues to be an ongoing need.

Consequently, a need exists for the design, function and use of a apparatus and method for collecting and disposing of pet waste using an oxidizing agent or neutralizing agent pet waste collection systems.

SUMMARY OF THE INVENTION

It is therefore an object of the present invention to provide a pet waste collection system for chemically neutralizing disease vectors within animal feces.

Features of the present invention include providing a pet waste collection system that allows for collection of pet feces in a manner that mixes the same with an effective amount of a chemical neutralizer in a manner that is easily transported, easily stored, easily applied, and adequately introduces the effective amount of chemical into a chemical neutralization process chamber.

In a preferred aspect of the present invention, a pet waste collection and neutralizing apparatus is providing having a scooper assembly portion nesting with a container assembly portion. A chemical cartridge pack is retained within the container assembly portion. The scooper assembly portion forms a receiving chamber forming a front opening and a flanged scoop circumscribing and extending from the front opening in a manner that is adapted to provide a scoop structure for collection of pet feces from the ground or a litter box. A motor mechanism operatively connected to a mixing blade assembly for comminuting, diminuting or pulverizing any collected contents. A front opening mates with a rear opening to form a containment volume. A rear opening is formed for receiving the chemical cartridge that provides for the containment and controlled release of a pet waste chemical neutralizer.

The pet waste neutralizer comprising substantially a natural clay material, a chemical or enzymatic reagent, and an organic component all mechanically agitated to a fine and uniform blend of material. A clay component is a natural clay such as bentonite, lime, zeolite, phylosilicate, smectites, palygorskite, sepiolite, kaolinite, talc, montmorillonite, saponite, or hectorite clay. The clays comprise a natural, fine-grained (<2 micron) particles having a negatively-charged structure capable of freely exchanges positively-charged cations or products from the environment in a manner that provides the easy application of metered chemical neutralizer to neutralize the collected pet waste into a safe compostible product.

Additional methods for killing such pathogens may also be included, such as ultra violet light, heat, laser, etc. Further features, benefits and aspects of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
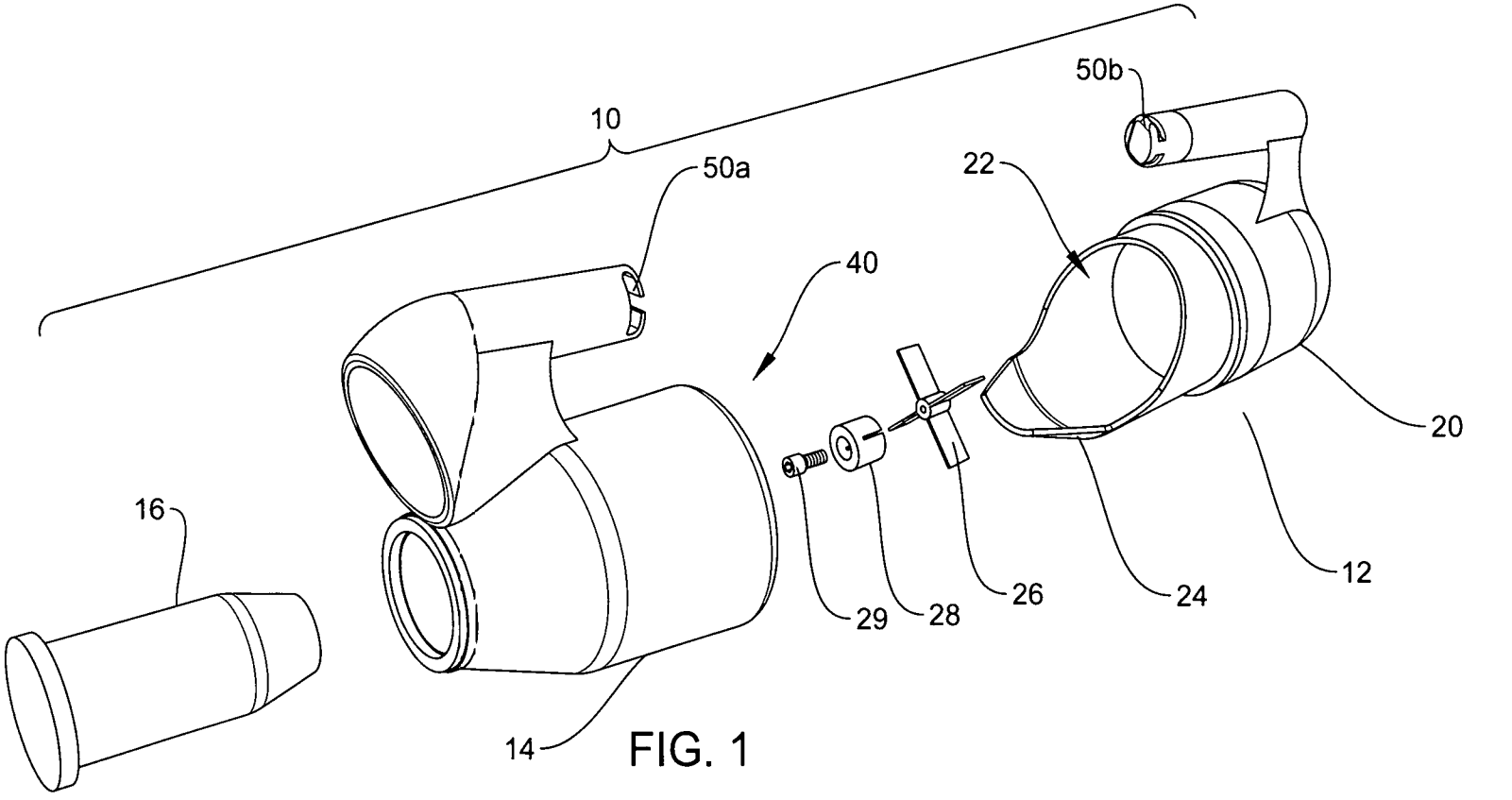
FIG. 1 is an exploded perspective view of a pet waste collection and neutralizing apparatus according to the preferred motorized embodiment of the present invention.
Figure 4:
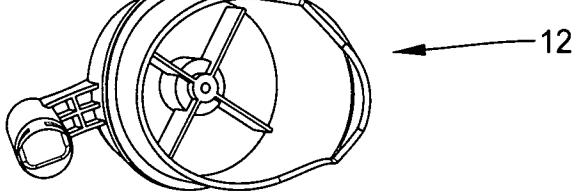
FIG. 4 is a front perspective view of a scooper assembly portion for use therewith.
Figure 3:
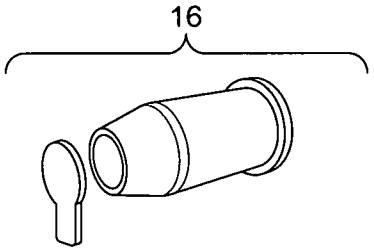
FIG. 3 is an exploded perspective view of the chemical cartridge pack of FIG. 2.
Figure 2:
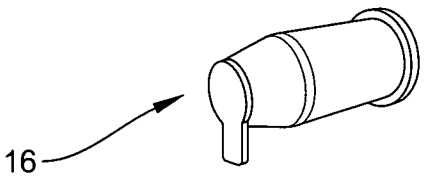
FIG. 2 is a perspective view of a chemical cartridge pack for use therewith.
Figure 6:
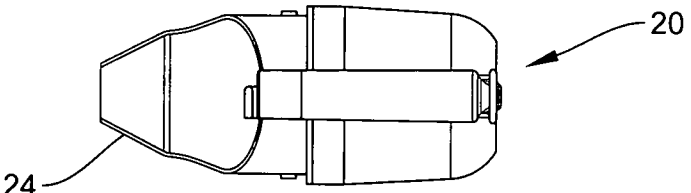
FIG. 6 is a bottom plan view thereof.
Figure 5:
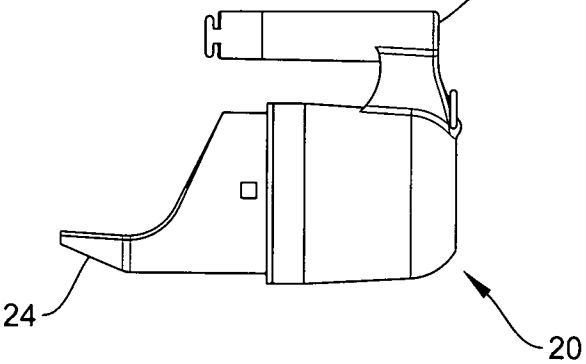
FIG. 5 is a side elevational view thereof.
Figure 8:
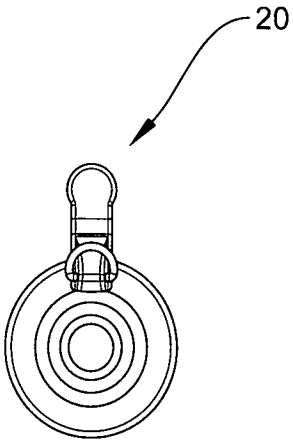
FIG. 8 is a front elevational view thereof.
Figure 7:
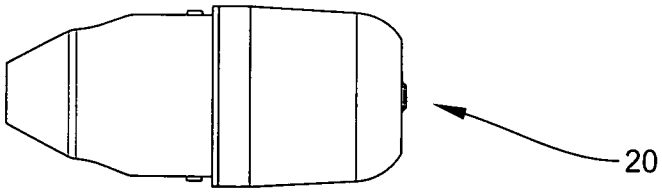
FIG. 7 is a top plan view thereof.
Figure 9:
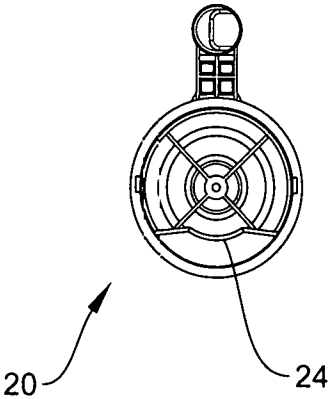
FIG. 9 is a rear elevational view thereof.
Figure 10:
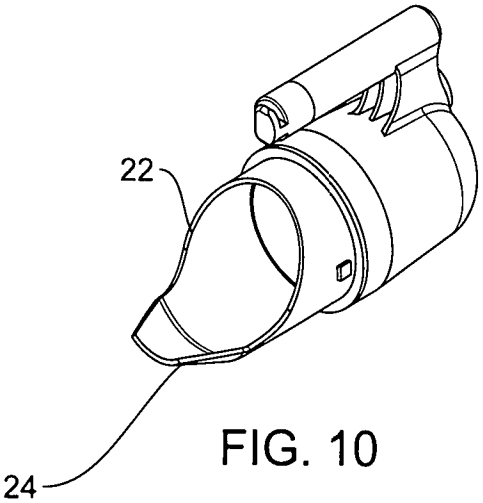
FIG. 10 is a front top perspective view thereof.
Figure 11:
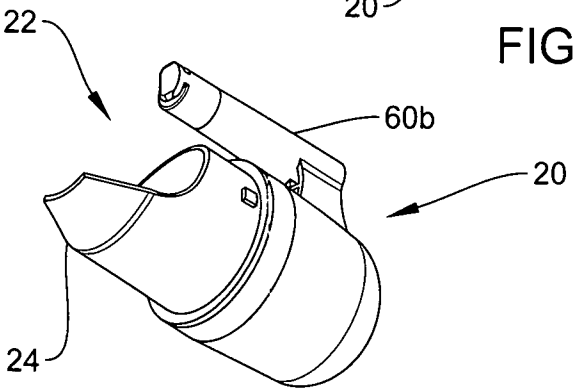
FIG. 11 is a front bottom perceptive view thereof.
Figure 15:
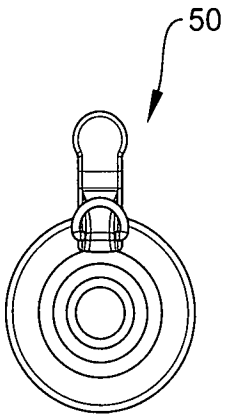
FIG. 15 is a front elevational view thereof.
Figure 14:
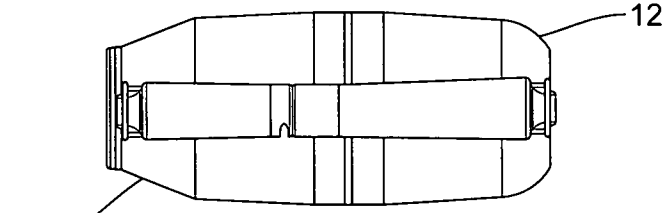
FIG. 14 is a top plan view thereof.
Figure 13:
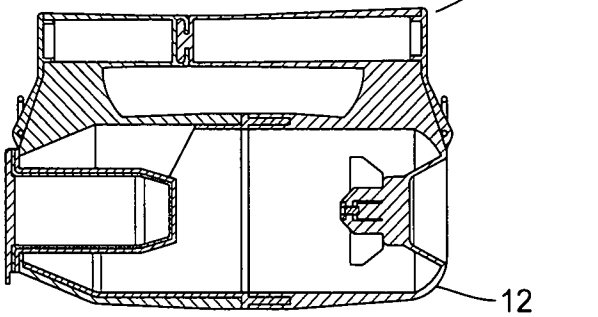
FIG. 13 is a cross sectional view taken along line A-A of FIG. 12.
Figure 12:
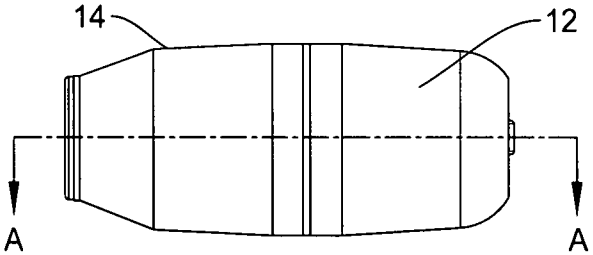
FIG. 12 is a bottom plan view of the pet waste collection and neutralizing apparatus according to the preferred embodiment of the present invention.
Figure 16:
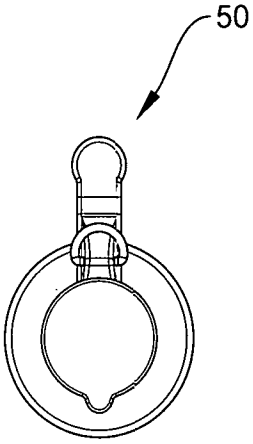
FIG. 16 is a rear elevational view thereof.
Figure 17:
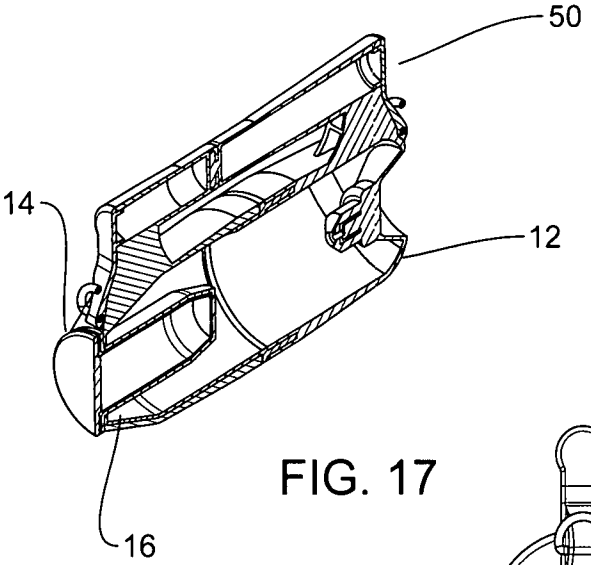
FIG. 17 is a front top perspective view of the cross sectional view of FIG. 13.
Figure 18:
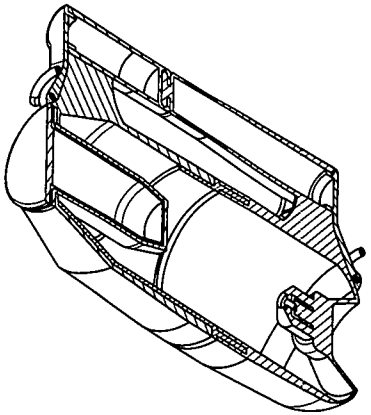
FIG. 18 is a front bottom perspective view thereof.
Figure 19:
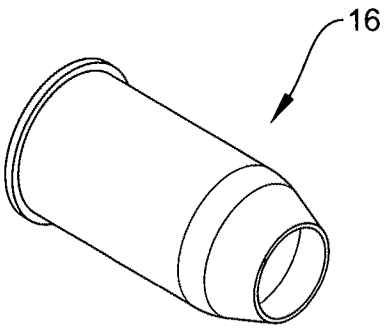
FIG. 19 is a rear perspective view of the chemical cartridge for use therewith.
Figure 22:
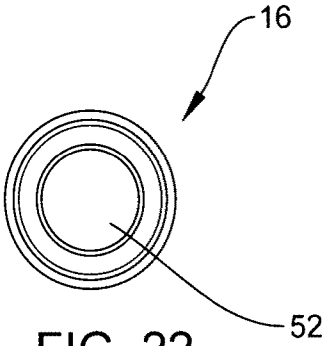
FIG. 22 is a rear elevational view thereof.
Figure 20:
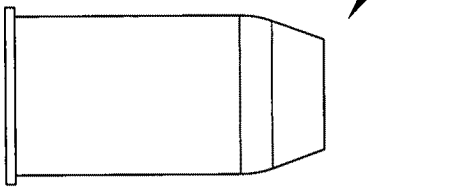
FIG. 20 is a top plan view thereof, the bottom plan view being a mirror image.
Figure 21:
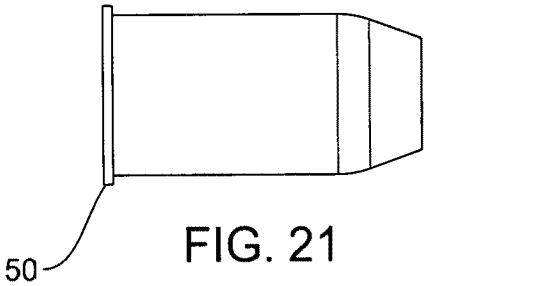
FIG. 21 is a left side elevational view thereof, the right side elevational view being a mirror image.
Figure 23:
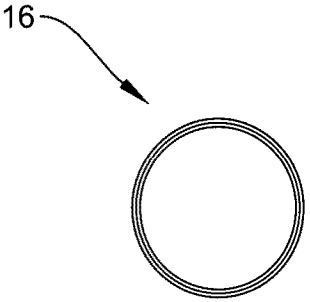
FIG. 23 is a front elevational view thereof.
Figure 24:
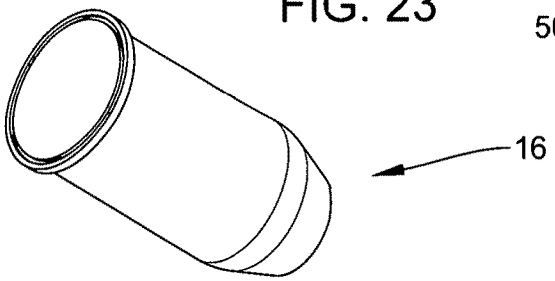
FIG. 24 is a rear perspective view thereof.

Referring now throughout the FIG. 1 through FIG. 24, a pet waste collection and neutralizing apparatus, generally noted as 10, is shown according to the preferred embodiment of the present invention. The apparatus 10 is composed of a scooper assembly portion 12, a container assembly portion 14, and a chemical cartridge pack 16.

The scooper assembly portion 12 forms a receiving chamber 20 forming a front opening 22. A flanged scoop 24 circumscribes and extends from the front opening 22 and provides a scoop structure adapted for collection of pet feces from the ground or a litter box. The scoop 24 guides collected materials into the inner chamber 20. A motor mechanism (not shown) if further housed within the scooper assembly portion 12 and is operatively connected to a mixing blade assembly 26. The blade 26 is retained with a blade enclosure cap 28 secured by a threaded connector 29. The blade 26 may be rotated by the motor mechanism in order to comminute, diminute or pulverize any collected contents.

The scoop 24 is received into the container assembly portion 14 such that the front opening 22 may mate with a rear opening 40. The container assembly 14 seals with the scooper assembly 12 to form a containment volume. Opposite the rear opening 40 is a cartridge receiving opening 44 for receiving the chemical cartridge 16. A sealing door 46 can snap or otherwise seal closed the containment volume.

An upper handle 50 provides a grasping element at the apex of the assembly 10. The handle 50 may be formed of a first handle portion 50*a* formed extending from the upper surface of the receiving chamber 20 and a second handle portion 50*b* formed extending from the upper surface of the container assembly portion 14.

Figure 25:
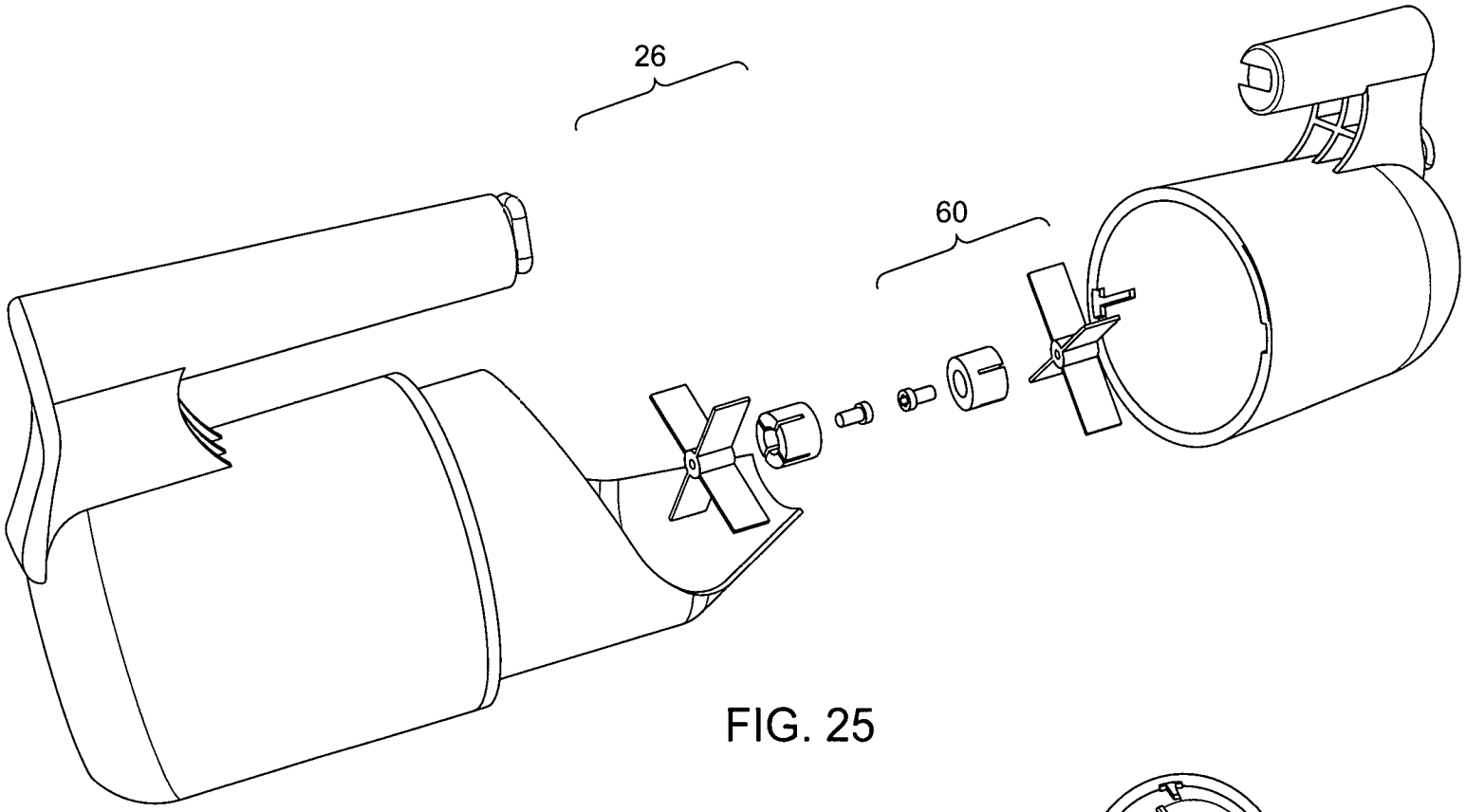
FIG. 25 is an exploded perspective view of a pet waste collection and neutralizing apparatus according to the preferred non-motorized embodiment of the present invention.
Figure 27:
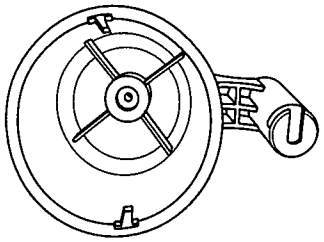
FIG. 27 is a rear perspective view of a collection side assembly for use therewith.
Figure 26:
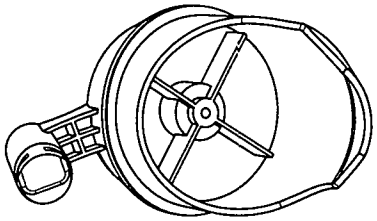
FIG. 26 is a front perspective view of the scooper side assembly for use therewith.
Figure 31:
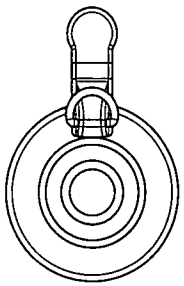
FIG. 31 is a front elevational view thereof.
Figure 30:
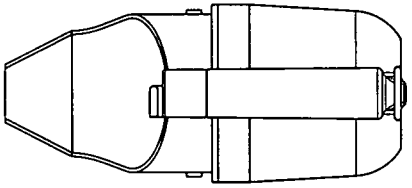
FIG. 30 is a top plan view thereof.
Figure 28:
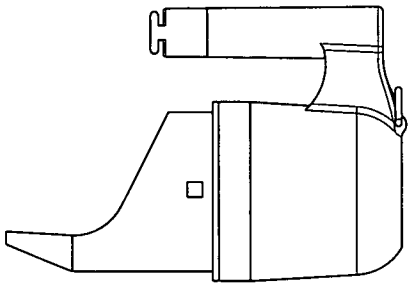
FIG. 28 is a side elevational of a scooper assembly portion for use therewith.
Figure 29:
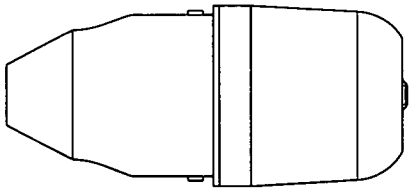
FIG. 29 is a bottom plan view thereof.
Figure 32:
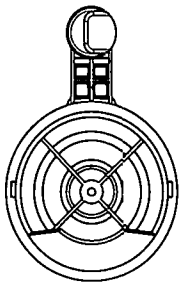
FIG. 32 is a rear elevational view thereof.
Figure 33:
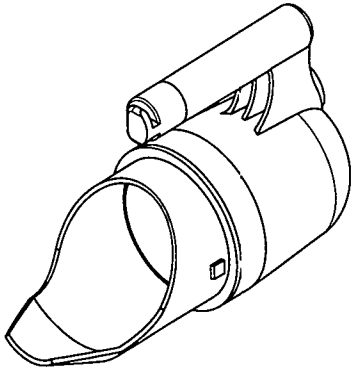
FIG. 33 is a front upper perspective view thereof.
Figure 34:
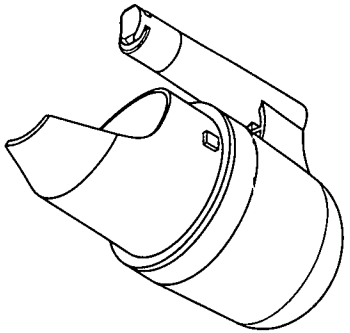
FIG. 34 is a front lower perspective view thereof.
Figure 38:
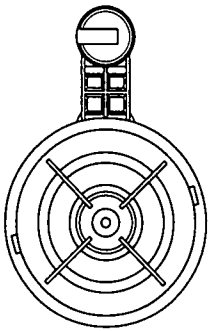
FIG. 38 is a front elevational view thereof.
Figure 37:
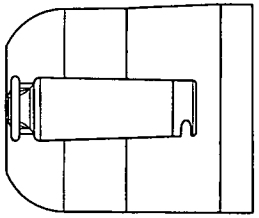
FIG. 37 is a top plan view thereof.
Figure 35:
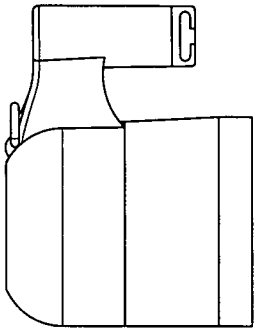
FIG. 35 is a side elevational view of a collection assembly portion for use therewith.
Figure 36:
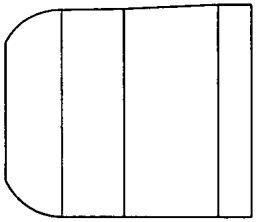
FIG. 36 is a bottom plan view thereof.
Figure 39:
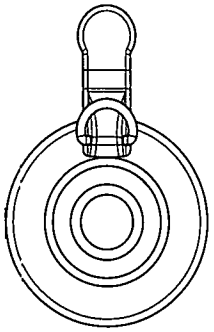
FIG. 39 is a rear elevational view thereof.
Figure 40:
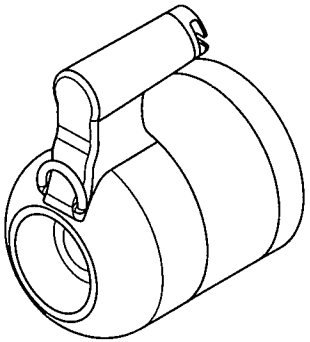
FIG. 40 is front upper perspective view thereof.
Figure 41:
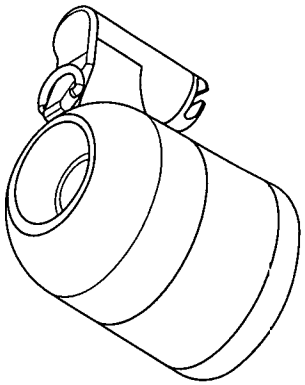
FIG. 41 is a front lower perspective view thereof.
Figure 43:
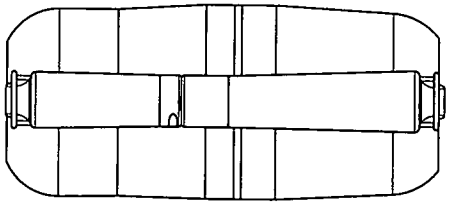
FIG. 43 is a top plan view thereof
Figure 44:
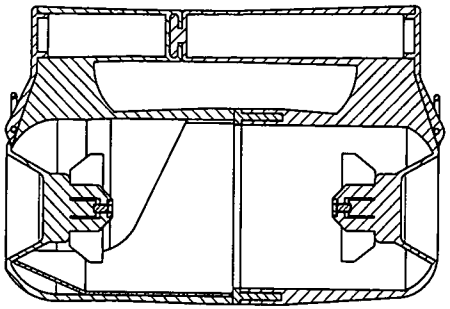
FIG. 44 is a cross sectional view taken along line A-A of FIG. 42.
Figure 45:
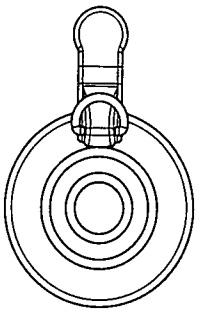
FIG. 45 front elevational view thereof.
Figure 42:
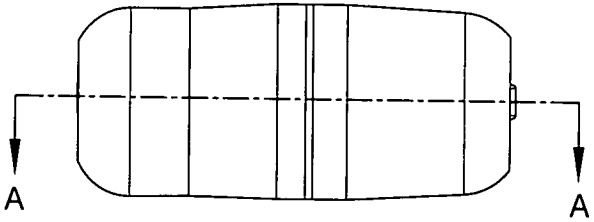
FIG. 42 is a bottom plan view of an assembled scoop assembly portion and collection assembly portion according to the preferred non-motorized embodiment of the present invention.
Figure 46:
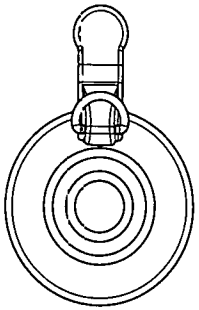
FIG. 46 is a rear elevational view thereof.
Figure 47:
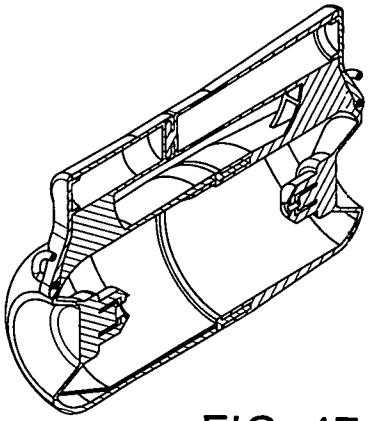
FIG. 47 is a front upper perspective view of the cross section of FIG. 44.
Figure 48:
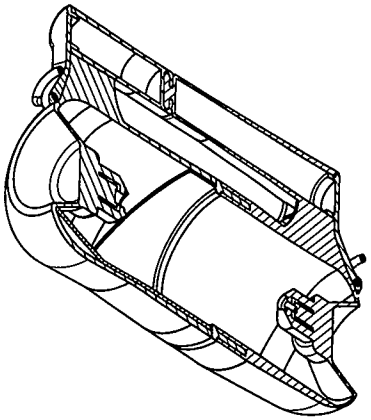
FIG. 48 is a front lower perspective view of the cross section of FIG. 44.
Figure 49:
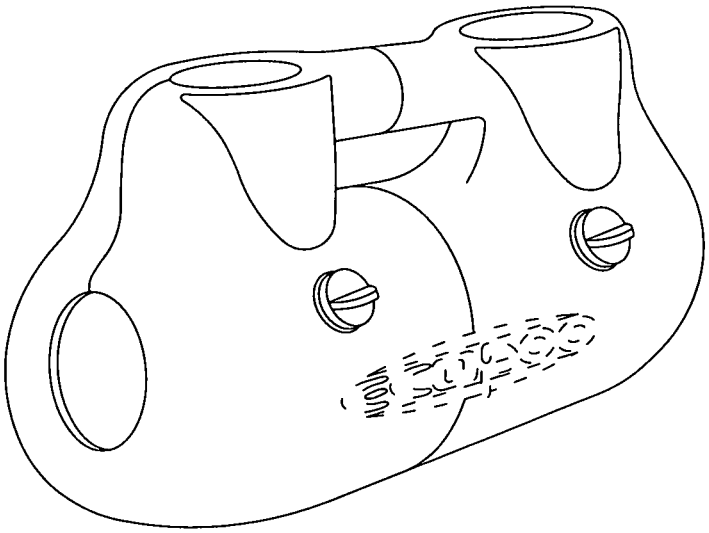
FIG. 49 is a perspective view of a pet waste collection and neutralizing apparatus according to a first alternate design of the present invention in which a top loaded chemical cartridge is utilized.
Figure 50:
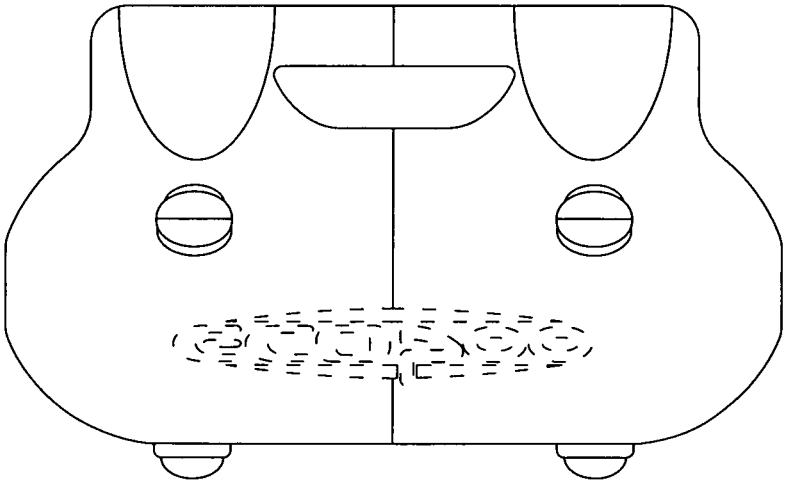
FIG. 50 is a front elevational view thereof.
Figure 51:
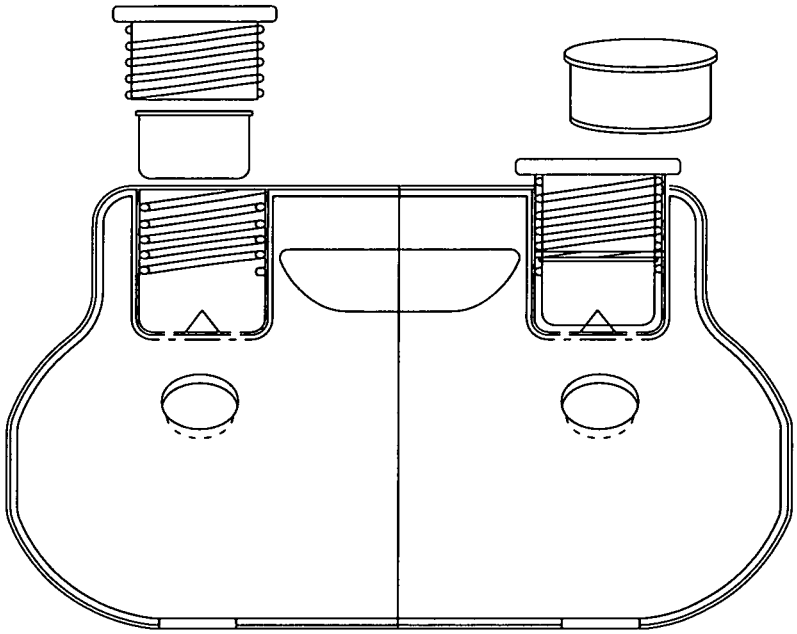
FIG. 51 is a partially exploded front cross sectional view thereof.
Figure 52:
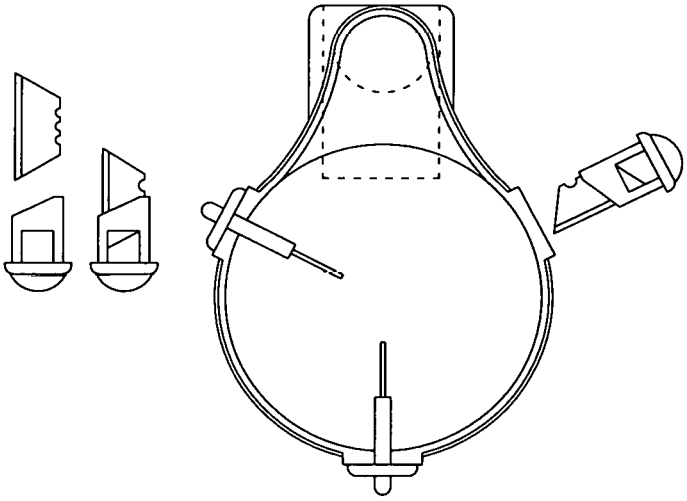
FIG. 52 is a top cross sectional view thereof.
Figure 53:
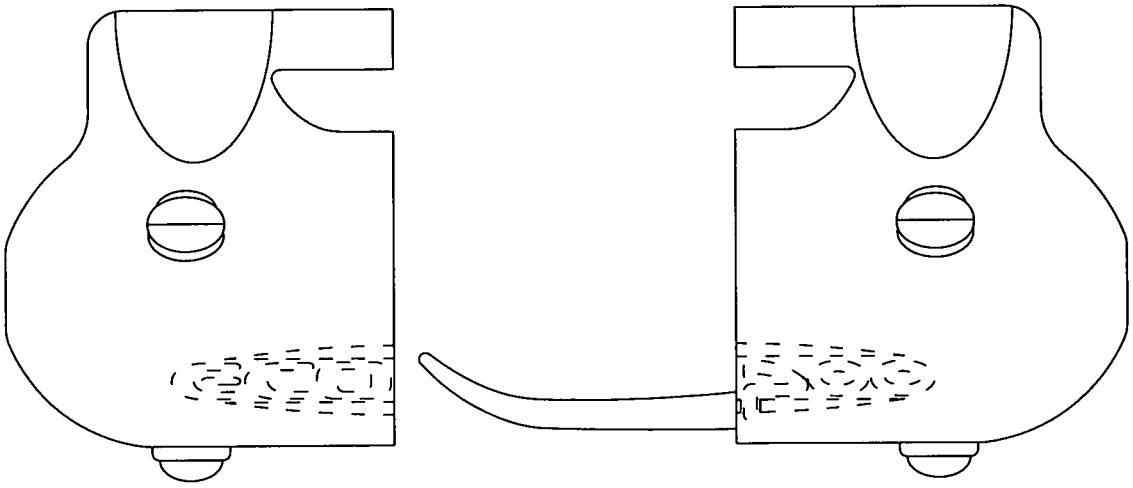
FIG. 53 is a front elevational view thereof shown in an open configuration.
Figure 54:
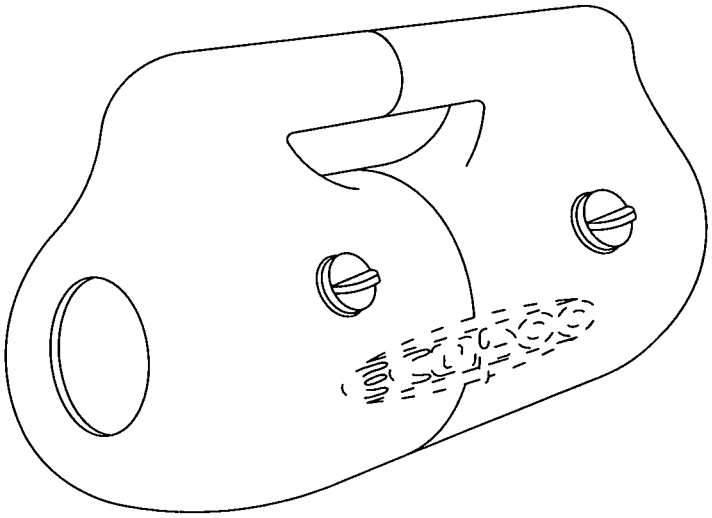
FIG. 54 is a perspective view of a pet waste collection and neutralizing apparatus according to a second alternate industrial design embodiment of the present invention.
Figure 55:
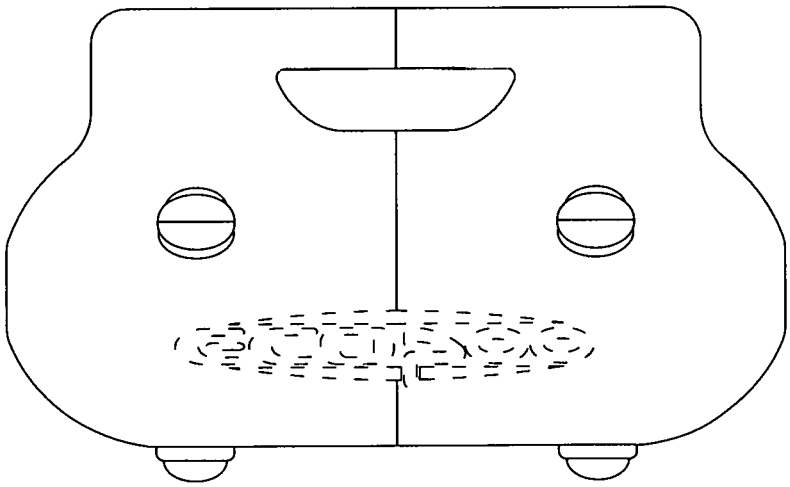
FIG. 55 is a front elevational view thereof.
Figure 56:
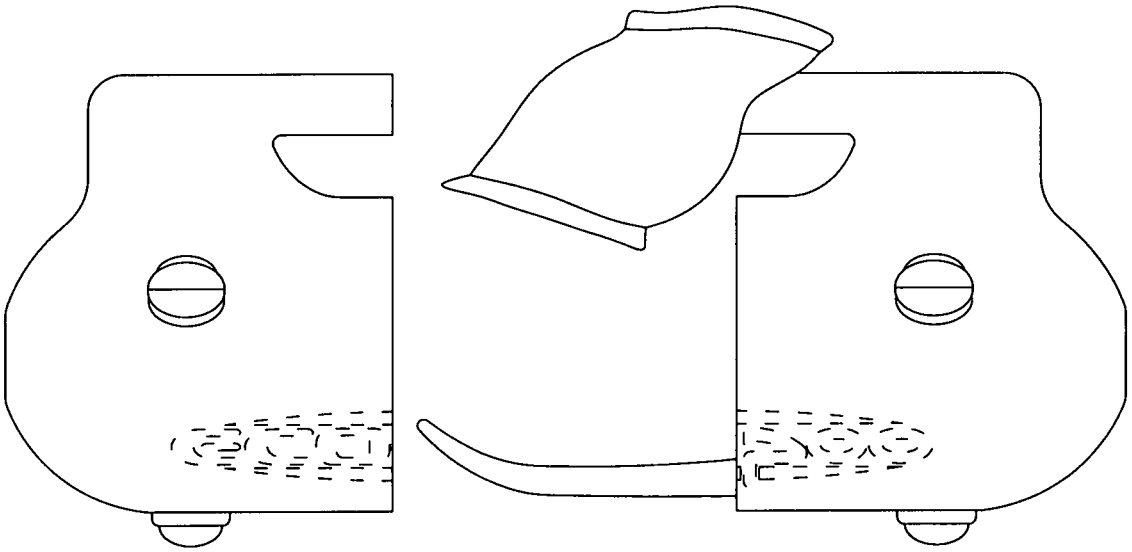
FIG. 56 is a partially exploded front elevational view thereof shown in an open configuration.
Figure 57:
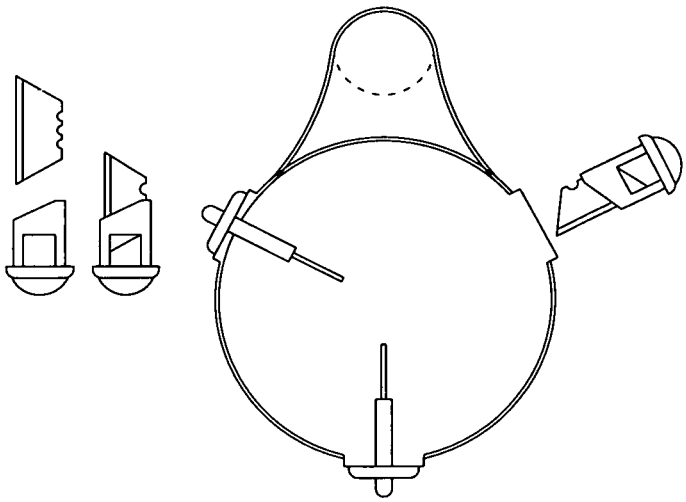
FIG. 57 os a top cross sectional view thereof.
Figure 58:
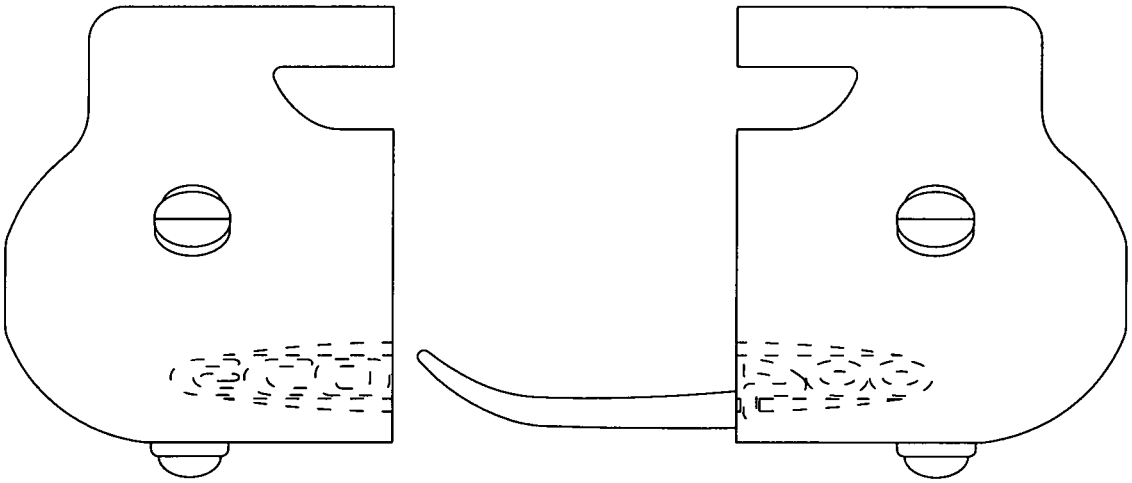
FIG. 58 front elevational view thereof shown in an open configuration.

As shown in a motorized embodiment in FIG. 1 through FIG. 24, the blade 26 may be rotated by the motor mechanism in order to comminute, diminute or pulverize any collected contents. In an alternate configuration, a non-motorized embodiment may be provided with most of the same features and structure, but without the use of a motor. As shown in conjunction with FIG. 25 through FIG. 48, a similar configuration is provided in which the blade assembly 26 is non-motorized and fixed to or freely rotatable against an inner sidewall of the scooper side assembly with a secondary blade assembly 60 spaced linearly apart and fixed to or freely rotatable against an inner sidewall of the collection side assembly. The pair of blade assemblies can thereby function to in order to comminute, diminute or pulverize any collected contents upon a vigorous shaking of the combined closed assembly so as to agitate the contents repeatedly against the blades.

In either motorized or non-motorized configuration, the chemical cartridge pack 16 provides for the containment and controlled release of a pet waste chemical neutralizer. The pet waste neutralizer is provided comprising substantially a natural clay material, a chemical or enzymatic reagent, and an organic component all mechanically agitated to a fine and uniform blend of material. The clay component may be a natural clay, such as bentonite, lime, zeolite or other or similar phylosilicate including smectites, palygorskite, sepiolite, kaolinite, talc, montmorillonite, saponite, and hectorite clays. Such clays are natural, fine-grained (<2 micron) particles having a negatively-charged structure. Negatively-charged clay surfaces freely exchanges positively-charged cations or products from the environment. Clays harbor unique properties that are important for various pharmaceutical and which further makes them useful in the present applications. These include small particle size, large surface reactivity, the presence of ion-exchange behavior, swelling and sorption properties, rheological properties, viscosity and flow behaviors, solubility, thermal capacities, plasticity features, and optical attributes.

According to one preferred aspect of the present invention, the use bentonite or zeolite clays provide a particular advantage due to the natural lattice structure of crystalline shape at the molecular level. These materials further absorb ammonia or urea, present in pet waste, and may subsequently lead to their controlled release in a manner that could function advantageously as a fertilizer. Additional chemical reagents that have shown a beneficial effect include bentonite, biochar (activated carbon), lime, calcium hypochlorite, papain, bromelain, diatomaceous earth, calcium oxide, calcium chloride, sodium acetate (salt), hydrogen peroxide, cassia oil, epsom salt (magnesium sulfate), and polyhexamethylene biguanide (PHMB). Further still other reagents may be used, such as magnesium chloride granules to speed up the exothermic reaction, citric acid to neutralize the smell of ammonia (generated from decaying matter), or zeolite granules for neutralizing odors The chemical or enzymatic reagent may include antibiotics, antimicrobials or microbiocides. Antibiotics are low molecular weight products that kill or inhibit the growth of susceptible microorganisms. In contrast, antimicrobial agents are synthetically-derived or chemically-modified compounds that exhibit antimicrobial activity at low concentrations. Ideally, antimicrobial compounds will disrupt microbial-specific processes or structures so that host toxicity and adverse side effects are minimized. Microbiocidal agents are chemical or physical agents that kill microorganisms and viruses and may include compounds categorized as disinfectants, antiseptics, and sanitizers. Disinfectants are designed to kill microorganisms and viruses, but should only be used on inanimate objects, while antiseptics and sanitizers kill or neutralize bacteria and viruses on the skin and some mucosal surfaces. By way of example, and not meant as a limitation, the use of calcium oxide or calcium chloride can function as exothermal reactants that kill or neutralize such pathogens.

Additionally, the use of essential oils may be used to confirm natural antibacterial activity, and can be used to kill bacteria as well as to improve the smell of the soiled product. As shown below in Table 1, a list of essential oils (*cassia* oil, clove oil, lavender oil, Peru balsam oil, red thyme oil, and tea tree oil) is provided with their antibacterial effect. As shown in Table 2, the in vitro antibacterial activities of essential oils (*Leptospermum* oil, lemon myrtle oil, and tea tree oil) is shown. Table 3 shows the in vitro antibacterial activities of essential oil single compounds. Tables 2 and 3 indicate the following that all essential oils tested had strong antimicrobial activity against *Campylobacter* spp. with inhibitory concentrations in the range of 0.001-1% (vol/vol). Further, among single compounds, terpinen-4-ol showed highest activity against *Campylobacter* spp., *E. coli, S. typhimurium*, and *E. faecalis*. Based on antimicrobial activity and potential commerciality, lemon myrtle oil, α-tops, and terpinen-4-ol are considerations for product development.

TABLE 1

| Essential Oil | Additive | Medium | Bacteria | MIC | Reference |
|---|---|---|---|---|---|
| Cassia oil (Cinnamomum aromaticum; 100% pure; Aura Cacia) | 0.1% Tween 80 | CAMHB | *Pseudomonas aeruginosa* PAO1 | 0.2% | (10) |
| Cassia oil (Cinnamomum aromaticum; 100% pure; Aura Cacia) | 0.1% Tween 80 | CAMHB | *Pseudomonas putida* KT2440 | 0.2% | (10) |
| Cassia oil (Cinnamomum aromaticum; 100% pure; Aura Cacia) | 0.1% Tween 80 | CAMHB | *Staphylococcus aureus* SC-01 | 0.2% | (10) |
| Cinnamaldehyde (from cassia oil) (Sigma-Aldrich) | 0.1% Tween 80 | CAMHB | *Pseudomonas aeruginosa* PAO1 | 0.1% | (10) |
| Clove oil (Szyygium aromaticum) | 0.1% Tweer 80 | CAMHB | *Pseudomonas aeruginosa* PAO1 | >5% | (10) |
| Clove oil (Szyygium aromaticum) | 0.1% Tween 80 | CAMHB | *Pseudomonas putida* KT2440 | >5% | (10) |
| Clove oil (Szyygium aramaticum) | 0.1% Tween 80 | CAMHB | *Staphylococcus aureus* SC-01 | 1.2% | 10) |
| Eugenol (from clove oil) (Sigma-Aldrich) | 0.1% Tween 80 | CAMHB | *Pseudomonas aeruginosa* PAO1 | >5% | (10) |
| Lavender oil | 0.1% Tween 80 | CAMHB | *Pseudomonas aeruginosa* PAO1 | >5% | (10) |
| Lavender oil | 0.1% Tween 80 | CAMHB | *Pseudomonas putida* KT2440 | >5% | (10) |
| Lavender oil | 0.1% Tween 80 | CAMHB | *Staphylococcus atareus* SC-01 | 5% | (10) |
| Linalool (from lavender oil) (Sigma-Aldrich) | 0.1% Tween 80 | CAMHB | *Pseudomonas aeruginosa* PAO1 | >5% | (10) |

TABLE 1-continued

| Essential Oil | Additive | Medium | Bacteria | MIC | Reference |
|---|---|---|---|---|---|
| Peru balsam oil (Myroxylon balsamum) | 0,1% Tween 80 | CAMHB | *Pseudomonas aeruginosa* PAO1 | 2.5% | (10) |
| Peru balsam oil (Myroxylon balsamum) | 0.1% Tween 80 | CAMHB | *Pseudomonas putida* KT2440 | 2.5% | (10) |
| Peru balsam oil (Myroxylon balsamum) | 0,1% Tween 80 | CAMHB | *Staphylococcus aureus* SC-01 | 2.5% | (10) |
| Red thyme oil (Thymus vulgaris) | 0.1% Tween 80 | CAMHB | *Pseudomonas aeruginosa* PAO1 | >5% | (10) |
| Red thyme oil (Thymus vulgaris) | 0.1% Tween 80 | CAMHB | *Pseudomonas putida* KT2440 | 2.1-2.5% | (10) |
| Red thyme oil (Thymus vulgaris) | 0.1% Tween 80 | CAMHB | *Staphylococcus aureus* SC-01 | 0.8% | (10) |
| Tea tree oil (Melaleuca alternifolia) | 0.1% Tween 80 | CAMHB | *Pseudomonas aeruginosa* PAO1 | 5% | (10) |
| Tea tree oil (Melaleuca alternifolia) | 0.1% Tween 80 | CAMHB | *Pseudomonas putida* KT2440 | 2.5% | (10) |

TABLE 2

| Essential Oil | *C.jejuni* C338 (MIC %) | *C.jejuni* 3393 (MIC %) | *C. coli* (MIC %) | *E. coli* (MIC %) | *S. typhimurium* (MIC %) | *E. faecalis* (MIC %) | Reference |
|---|---|---|---|---|---|---|---|
| Leptospermum oil | 0.01 | 0.01 | 0.01 | 0.06 | 0.25 | 0.25 | (11) |
| Lemon myrtle oil | 0.01 | 0.01 | 0.007 | 0.06 | 0.125 | 0.125 | (11) |
| Tea tree oil | 0.001 | 0.001 | 0.001 | 0.03 | 0.03 | 0.125 | (11) |

TABLE 3

| Compound | *C. jejuni* C338 (MIC %) | *C. jejuni* 3393 (MIC %) | *C. coli* ATCC 43484 (MIC %) | *E. coli* O26 (MIC %) | *S. typhimurium* ATCC 14028 (MIC %) | *E. faecalis* ATCC 29212 (MIC %) | Reference |
|---|---|---|---|---|---|---|---|
| Terpine n-4-ol | 0.06 | 0.06 | 0.06 | 0.06 | 0.06 | 0.5 | (11) |
| α-Tops | 0.06 | 0.06 | 0.06 | 0.06 | 0.06 | 0.5 | (11) |
| α-Bisabolol | 0.5 | 0.125 | 0.5 | 2 | >2 | >2 | (11) |
| α-Terpinene | 0.25 | 0.125 | 0.125 | >2 | >2 | >2 | (11) |
| γ-Tops | 0.25 | 0.06 | 0.25 | >2 | >2 | >2 | (11) |
| Cineole | 0.25 | 0.25 | 0.25 | 1 | 2 | >2 | (11) |
| Nerolidol | 0.5 | 0.5 | 1 | >2 | >2 | >2 | (11) |

Broth microdilution assays (triplicate); Nutrient Broth No. 2 (Oxoid), microaerophilic or aerobic, 37° C.
Dilutions - ethanol/polyoxyethylene fatty glyceride (EtOH/PFG, 1/1 vol/vol) - increased solubility of test agents in liquid medium without resulting in foam.
Tween 80 0.002% vol/vol included in all experiments.
α-Tops: α-Terpineol, Cineole, Terpinen-4-ol
γ-Tops: γ-Terpinene, α-Terpinene, Terpinolene As further shown in Table 4, the in vitro antibacterial activity of clove oil is shown, and Table 5 shows the in vitro antibacterial activity of carvacrol, a compound from oregano oil.

TABLE 4

| Essential Oil | *C.jejuni* NCTC 11168 MIC | *C.jejuni* NCTC 1168 MBC | Reference |
|---|---|---|---|
| Clove | 200 mg/ml | 800 mg/ml | (12) |

| Essential Oil | *C.jejuni* 108 MIC | *C.jejuni* 81116 MIC | Reference |
|---|---|---|---|
| Carvacrol (Sigma) | 0.3-0.4 mM | 0.3-0.4 mM | (13) |

As shown in Tables 4 and 5, low concentration of clove oil (800 mg/ml) is bactericidal against *Campylobacter jejuni* and low concentration of carvacrol (0.3-0.4 mM) inhibits *Campylobacter jejuni*.

An organic component may include organic materials such as switchgrass, but can also include coconut husk powder, papain (i.e. *papaya* tree sap) or other sources of cellulose, tannin, cutin, and/or lignin.

The chemical neutralizer is contained within a generally cylindrical cartridge 16 having a selected volume for containing the oxidizer. The volume may be approximately 30 grams. The cartridge 16 may be formed around a selected designed guide tube for a standard size. The tube may be formed of a molded paper fiber pulp. Such standard volumes may be provided in increments in order to accommodate the incinerations of various standard volumes of feces (i.e. that for breeds of dogs that are toy, small, medium, large, etc. or the like).

The cylindrical cartridge 16 forms a guide tube that is terminated at one end with an radially extended flange or lip 50, and is sealed at the opposite end with a paper, foil, plastic or similar seal 52.

2. Operation of the Preferred Embodiment

In operation, the present invention and those design adaptations within the present inventions broad range of equivalents may be used with or adapted to an apparatus for pet waste disposal in which chemical oxidizers are introduce into a process chamber along with pet waste in order to chemically oxidize the pet waste through an exothermic reaction. The use the system, a user scoops a bolus of pet waste into the scooper assembly and connects the scooper assembly to the container assembly. A chemical cartridges for dispensing of chemical neutralizer is further inserted into the opposite end of the container assembly where is the sealed foil/paper/plastic end is removed in a manner that provides for fluid outflow into the process chamber. Additional ways to kill pathogens may alternately be utilized, such as ultra violet light, heat, laser, etc. in accordance the precent process and device. The chamber is sealed and the blade assembly is actuated with a control at the handle. The volume of pet waste is thereby combine and mixed with the chemical neutralizer and blended for an appropriate dwell time such that an exothermic chemical reaction is maintained in order for the selected pathogens within the waste to be rendered safe and thereby allowing the resultant to disposed of safely or used as a compost.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp.* v. *Shoketsu Kinzoku Kogyo Kabushiki Co.,* 535 U.S. 722 (2002), or other similar caselaw or subsequent precedent should not be made if any future claims are added or amended subsequent to this Patent Application.

Having thus described the invention what is claimed as new and desired to be secured by Letters Patent is as follows:

1. An apparatus for pet waste disposal comprising:

a pet waste collecting and mixing system adapted to receive a standardized cartridge;

a cartridge having a form factor for holding a chemical neutralizer;

a receiving chamber for accepting said cartridge and releasing the chemical neutralizer into a process chamber of the pet waste collecting and mixing system;

a portable waste collection receptacle comprising a first surface that has an opening for entry therein of feces and exit of ash or other combustion products;

a carrying handle connected to said portable waste collection receptacle; and said receiving chamber mounted together with and in fluid communication with said waste collection receptacle;

wherein waste disposed in said waste collection receptacle is chemically neutralized when mixed with said chemical neutralizer.

2. The apparatus according to claim 1, further comprising a mechanism adapted to comminute, diminute or pulverize any contents of said collection receptacle.

3. The apparatus according to claim 2, wherein said chemical neutralizer includes a natural clay material component mixed with an antimicrobial/antibacterial materials and in combination with absorbent organic material.

4. A pet waste collection and neutralizing apparatus comprising:

a scooper assembly portion nesting with a container assembly portion, wherein said scooper assembly portion forms a receiving chamber forming a front opening and a flanged scoop circumscribing and extending from the front opening adapted to provide a scoop structure for collection of pet feces from the ground or a litter box;

said scoop received into the container assembly portion;

a chemical cartridge pack for retention within said container assembly portion; and a motor mechanism housed within the scooper assembly portion and that is operatively connected to a mixing blade assembly;

wherein said motorized mixing blade assembly is adapted comminute, diminute or pulverize any collected contents;

wherein a rear opening is formed for receiving the chemical cartridge pack.

5. The pet waste collection and neutralizing apparatus of claim 4, wherein said chemical cartridge pack provides for the containment and controlled release of a pet waste chemical neutralizer.

6. The pet waste collection and neutralizing apparatus of claim 5, wherein the pet waste neutralizer comprising substantially a natural clay material, a chemical or enzymatic reagent, and an organic component all mechanically agitated to a fine and uniform blend of material.

7. The pet waste collection and neutralizing apparatus of claim 6, wherein said clay component is selected from a group comprising: bentonite; lime; zeolite; phylosilicate;

smectites; palygorskite; sepiolite; kaolinite; talc; montmorillonite; saponite; and hectorite clays.

8. The pet waste collection and neutralizing apparatus of claim 7, wherein said clay component comprises natural particles having an average grain size of less than 2 microns and having a negatively-charged structure capable of exchanging positively-charged cations or products from the environment.

* * * * *